United States Patent [19]

Gerding

[11] 4,073,334

[45] Feb. 14, 1978

[54] TILTING TUNDISH

[75] Inventor: Charles Christian Gerding, Pittsburgh, Pa.

[73] Assignee: Jones & Laughlin Steel Corporation, Pittsburgh, Pa.

[21] Appl. No.: 738,923

[22] Filed: Nov. 4, 1976

[51] Int. Cl.[2] ..... B22D 11/06; B22D 11/10

[52] U.S. Cl. ..... 164/87; 164/427; 222/64; 222/607

[58] Field of Search ..... 164/87, 136, 155, 276, 164/281; 222/607, 166, 52, 64; 266/236

[56] References Cited

U.S. PATENT DOCUMENTS

| | | | |
|---|---|---|---|
| 2,458,236 | 1/1949 | Wolff | 164/337 |
| 2,804,665 | 9/1957 | Harter et al. | 164/281 |
| 3,645,322 | 2/1972 | Properzi | 164/87 |
| 3,907,163 | 9/1975 | Gerding et al. | 222/590 |

FOREIGN PATENT DOCUMENTS

| | | | |
|---|---|---|---|
| 1,180,492 | 6/1961 | Germany | 222/166 |

*Primary Examiner*—Francis S. Husar
*Assistant Examiner*—John McQuade
*Attorney, Agent, or Firm*—Gerald K. White; T. A. Zalenski

[57] ABSTRACT

One or more pulsating streams of liquid material may be transformed into streams of essentially constant velocity with use of a counterweighted tundish that tilts in response to variations in liquid input. The dispensing system is particularly suited for use as a feeding source of liquid metal for continuous strip casting processes due to its ability to provide a constant low velocity teeming stream.

9 Claims, 5 Drawing Figures

TILTING TUNDISH

This invention is generally premised upon the discovery that pulsating flows of liquids may be transformed and dispensed at a constant controlled velocity by use of a rotatable container which maintains a constant liquid height over its dispensing opening despite fluctuations in the volume of liquid contained in the container.

The dispensing container of the invention is especially suitable for use as a tundish for teeming molten metal into strip casting apparatus such as that described in U.S. Pat. No. 3,773,102. In the above mentioned mode of use, a relatively low metal level is maintained over the tundish's outlet orifice so as to dispense molten metal by gravity flow at a constant low velocity and thereby avoid damage and remelting to the ring portion of casting device. U.S. Pat. No. 3,467,284 illustrates a tundish that may be used to feed molten metal to strip casting apparatus. This tundish system utilizes a hydraulic jack arrangement to tilt and clear the tundish at the process endpoint.

The device of the invention includes a rotatable container having a bottom, closed sides, and openings for receiving and dispensing liquids. The container is supported along the longitudinal axis of suitable bearings in a manner that permits the container to rotate a few degrees about the axis. The container is off-set from the longitudinal axis of rotation so that the weight of liquid in the container will exert a torque about the axis. Counter torque means are employed to exert a separate resisting torque against the container that balances the torque created by the container and its contained liquid. Rotation is caused by addition or subtraction of liquid which changes the amount of torque exerted by the overhanging container and causes the tundish to turn to seek a new balance point. The shape of the container and nature of the counter-torque means are such that the liquid depth in the container over the dispensing opening remains substantially constant despite rotation of the container with variations in volume of contained liquid. Because of the relatively constant liquid level over the dispensing opening, the materal will be dispensed at a constant rate because of gravitational effects.

It is thus an object of the invention to provide a method and apparatus for dispensing liquid material at a controlled rate. It is a further objective to provide a method and apparatus for dispensing a liquid at a constant low velocity. Another objective is to provide a tundish suitable for feeding liquid material into continuous strip casting machines. These and other objectives and advantages will be apparent to those skilled in the art from the following description of the invention.

Figure 5:
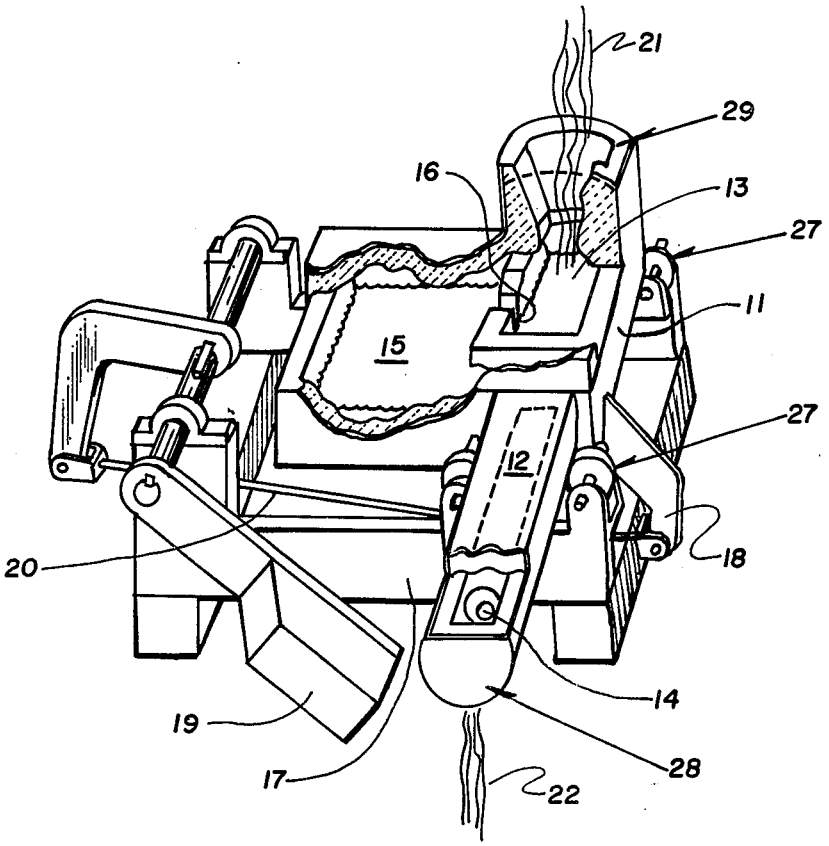
FIG. 5 is a perspective view of an embodiment of the tundish of the invention.

The principles underlying the operation of the tiltable dispensing container may be visualized by first considering an instance where an empty rotatably supported container having a closed exit orifice is slowly filled with liquid. In actual operation, the empty container will rest against an upper stop member because the torque exerted by the empty container will be overbalanced by that of the counterweight system. For purposes of this illustration, it is assumed that the counterweight is a simple weight rigidly affixed to the container by an arm that disposes the counterweight in a preferred position. As liquid enters the container, it seeks its own level and since the center of gravity of this liquid mass is offset horizontally from the center of rotation, an increased torque over and above that of the empty container is created about at the support axis until the container is released from the stop which occurs when the increased torque just exceeds that of the counterweight system. At this point the system is balanced and additional liquid input results in rotation of the container about the axis of the support member to a position in which the newly created torque is balanced by that of the counterweight system. Rotation of the container also causes rotation of the rigidly affixed counterweight and a consequent incremental increase in the counter-torque exerted by the counterweight because the counterweight is now a greater horizontal distance from the axis of rotation of the container. The newly created torque balance in the system does not lead to the rise in liquid height in the container over the dispensing opening that would pertain had the rotation not occurred. The relative amount of change in liquid height in the container is influenced by container shape and by the design of the counterweight system. For example, the use of a container having inwardly sloping sidewalls will tend to result in liquid height increases as the tundish tilts downward while those having outwardly sloping sidewalls will tend to result in decreases in liquid height. Of course, it is also possible to utilize a container shape that will tend to result in an essentially constant metal height despite the addition of liquid to the container. For purposes of simplicity of construction vertical container sidewalls as shown in FIG. 5 are preferred.

As apparent from the above discussion, both container shape and counterweight system have an influence upon torque change as liquid is added to the container. Thus, for a given container shape, the counterweight system is designed, as closely as possible, to exert a compensating change in counter torque to offset the torque added by the addition of liquid for each angle of container rotation where the liquid height over the dispensing opening is maintained constant. This is a matter of engineering design and experimentation because even the nonpreferred container shapes described above can be utilized to achieve essentially constant liquid heights through use of a variable compensating counter torque system.

The invention is suitable for use with a pulsating (including but not limited to one or more off-on streams) input of liquid material and will deliver an essentially constant output of liquid due to regulation of liquid height over the dispensing opening. Thus, during input fluctuations, the container is caused to rotate or pivot about an axis by the balancing system and thereby contain a variable volume of liquid material at a constant height over the dispensing opening. The principles previously described in connection with the closed exit orifice are, of course, operable with an open orifice such as a flow nozzle or a weir which dispenses a constant liquid stream under the influence of gravity when the liquid head is held constant. In this situation, input pulsations cause the container to rotate, both in clockwise and counterclockwise directions, due to the variable quantity of liquid held in the container.

Figure 1:
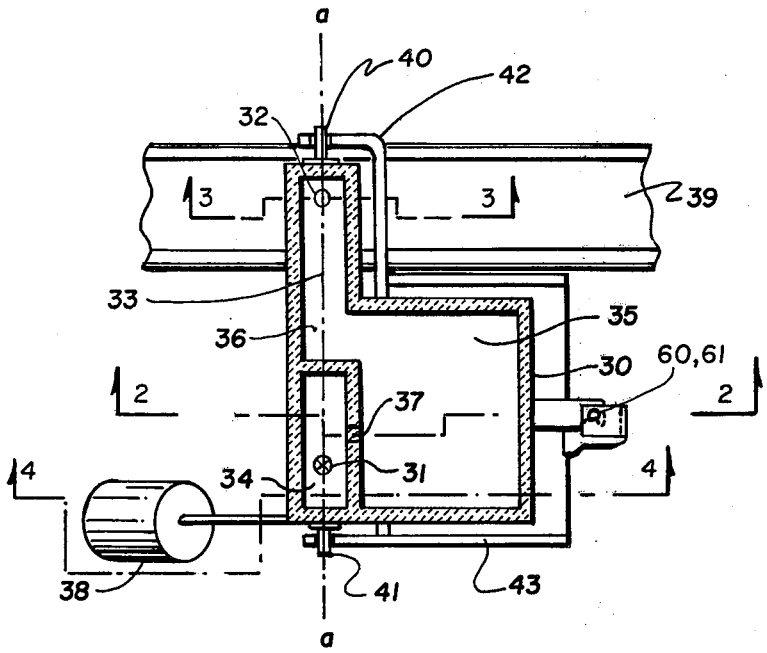
FIG. 1 is a top view of a tundish in combination with a strip casting ring.

FIG. 1 is a top view of an embodiment of the invention which illustrates the relationship of a tundish in combination with the ring portion of a continuous strip casting device. This embodiment utilizes refractory lined tundish 30 which is rotatably supported about horizontal axis *a—a*, designated by 33, by suitable support means. Input opening area 31 and output orifices 32 are located substantially along the vertical plane containing said axis so as to minimize disturbance of the torque balancing function of the system. Tundish 30 comprises inlet chamber 34, holding chamber 35, and dispensing chamber 36. Chambers 34 and 35 are connected by transfer orifice 37, to permit liquid flow between these chambers. Two chambers, rather than a single chamber, are utilized in this embodiment so as to function to dampen any waves or turbulence created by pulsations in the incoming liquid. Counterweight 38 is attached to tundish 30. The tundish system functions to dispense a constant stream of desired velocity on to moving channel-shaped casting ring 39 where the stream may be solidified and cast into strip form in accordance with the principles disclosed in U.S. Pat. No. 3,773,102. Knife edge arms 40 and 41 are attached to the tundish and are balanced in support bearings 42 and 43 so as to permit rotation of the tundish.

Figure 2:
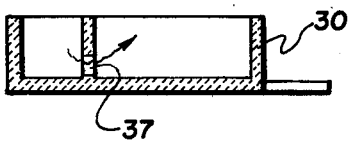
FIG. 2 is a sectional view along line 2—2 of FIG. 1.
Figure 3:
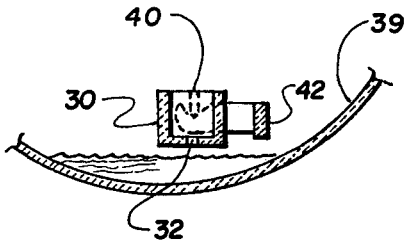
FIG. 3 is a sectional view along line 3—3 of FIG. 1.

FIGS. 2 and 3 are sectional views taken along sections 2—2 and 3—3, respectively of FIG. 1. FIG. 2 illustrates transfer orifice 37 in greater detail. FIG. 3 depicts a simple knife edge bearing arrangement in which knife edge arm is held by support bearing 42.

Figure 4:
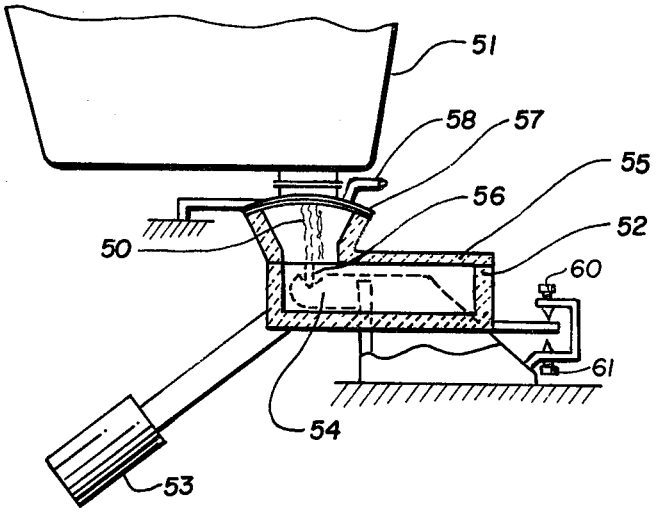
FIG. 4 is a sectional view along line 4—4 of FIG. 1 in combination with liquid input means such as a ladle.

FIG. 4 is a sectional view taken along line 4—4 which is near an end of the tiltable tundish of FIG. 1 which includes an input source. Molten metal stream 50 is fed or transferred from ladle 51 into refractory lined tundish 52. The tundish is shown with closed top 55 and stationary shrouding member 57 whereby inert gas from line 58 may be introduced to protect the molten metal in the tundish from oxidation where such metal is held and dispensed as described elsewhere. Counterweight means 53 serve to provide the required counter torque so as to permit tundish 52 to rotate about the longitudinal horizontal axis of support bearing 54. Stops 60 and 61 limit upward and downward travel of the tundish. Although support bearing 54 is shown in combination with knife edge 56, it will be understood that the requisite type of support could be provided by other types of bearing members. For example, simple journal-in-bearing pivots or, similar pivots fitted with anti-friction ball or roller bearings, wires, tapes or other elastically flexing suspension members are all suitable for the suspension of the tundish in that the bearing need only provide a few degrees of rotation of the tundish body.

FIG. 5 is a perspective view of a tundish suitable for dispensing molten metal to a strip casting device and serves to generally illustrate a preferred embodiment of the invention. Tundish container 11 includes first chamber 13 which is adapted to receive molten metal stream 21 and to dispense molten metal to second chamber 15 which functions to contain molten metal flowing from chamber 13 through opening 16 until it flows into chamber 12 to be dispensed by outlet orifice 14. Tundish container 11 is rotatably supported by journal mounted rollers 27 which are affixed to base support means 17. Tundish 11 is rotatably supported about the longitudinal axis of the bearing surface that is generally coplanar with receiving opening 29 and dispensing opening 14 of chamber 12. Such support arrangement permits tundish 11 to rotate about the bearing surface with variations in torque caused by variations in the amount of contained molten metal. Variable quantities of molten metal can be accommodated in second chamber 15.

Counter torque means 18 are connected to tundish container 11 so as to apply a torque that will balance the torque exerted about its center of rotation by tundish 11 and its content of molten metal. Counter torque means 18 include counterweight 19 and linkage system 20. Linkage system 20 serves to apply the counter torque at a location appropriate to balance the system.

In its intended mode of operation, pulsating molten metal stream 21 is teemed into receiving opening 29 so as to partially fill chambers 13, 15, and 12 to the extent that a torque greater than that exerted by counter torque means 18 is created. This causes tundish 11 to rotate in a counterclockwise direction about the longitudinal axis of the bearing surface until balanced by the counter torque applied by counter torque means 18. At this point, outlet orifice 14 may be opened (if not already open) to permit constant molten metal stream 22 to exit from chamber 12. Thereafter tundish 11 will rotate in a clockwise direction as it discharges metal, being balanced by counter torque means 18. However, during periods when additional molten metal is added to tundish 11 at a rate in excess of that exiting from the tundish, a counterclockwise rotation will result. Inasmuch as the molten metal is free to move between chambers 12 and 15 through orifice or opening 16, the molten metal height over the outlet orifice remains essentially constant throughout tundish 11 despite rotation of the tundish and is dispensed by gravity through outlet orifice 14 at a constant velocity. The ability to control metal height at a relatively constant height over the outlet orifice enables one to also easily control the dispensing rate. A relatively low pool height should be used to produce a low velocity stream in the event that the tundish is to be employed in combination with strip casting apparatus. On the other hand, relatively high pool heights may be utilized should a high velocity output be desired.

The counterweight system shown in FIGS. 1 and 4 consists of a simple weight mounted on a lever arm. The system shown in FIG. 5 is a linkage of several bars which permits the system to be located beneath the tundish in a more compact manner than that of FIGS. 1 and 4. Other systems of supplying a variable torque which is a function of the angle of inclination of the tundish body will readily occur to those skilled in the art. For example, a number of stationary weights may be arranged to be engaged at discrete angles by an arm on the tundish so that resistance to tilting is built up with increasing angle of tilt. A hydraulic balancing device in which the resistance of a shaped float to immersion in a body of liquid may be used to generate the desired torque function to counterbalance the overhanging tundish as it fills with metal.

It may also be desired to adjust the equilibrium level of liquid metal in the tundish and thus adjust the output rate. This can be accomplished through adding or subtracting weight to the tundish body or to some member of the counterweight system. In particular, regarding the strip casting process, it is also desirable to be able to shut off the flow of molten metal exiting from the tundish at any time. Obviously this can be done by adding a sizable weight to the tundish body which has the same effect upon the balance of the tundish as does a large input of metal. This causes the tundish to assume a maximum angle of tilt so that the contained metal level is lower than the entrance to the output weir or orifice and metal flow from the tundish immediately ceases.

Because the output weir or orifice must tilt with the tundish, it may be also preferable for the tundish to be designed so that the angle of tilt is limited to a few degrees. Where an orifice is used, it is assured that the exiting stream(s) from the tundish will be nearly vertical at all times. With a total angular travel of, for example, 10° during operation, streams are held to plus or minus 5° from vertical (having a 5° bias to allow this). This value leads to good operation of the nozzles. When a weir is used, the tolerable angle of tilt is determined by the placement of the weir; a weir located in endwall 28 of chamber 12 of FIG. 5, for example, would be relatively insensitive to angles of tilt greater than plus or minus 5°.

I claim:

1. A method for dispensing a substantially constant flow of liquid, comprising:

a. feeding a pulsating flow of liquid into a container that is rotatably supported by a bearing surface having a horizontal axis that is generally coplanar with an opening in said container for receiving said liquid and an opening in said container for dispensing said liquid, said container adapted to hold variable amounts of said liquid and extending laterally beyond said horizontal axis, so as to cause said container to rotate about said axis due to a change in torque applied to said container caused by the change in volume of contained liquid;

b. applying a countertorque from a counterweight system to said container to balance the change in torque caused by said change in volume of liquid, said countertorque being applied on an amount to cause the container to rotate about said axis to a position where the height of said liquid over said dispensing outlet remains essentially constant with the liquid height prior to application of said countertorque; and c. dispensing a substantially constant flow of liquid under the influence of gravity from said dispensing outlet.

2. A method for dispensing a substantially constant flow of liquid according to claim 1, wherein:

said pulsating flow of liquid is fed into said container at a rate such that said container does not rotate through an angle of more than 10° about said axis.

3. A method for dispensing a substantially constant flow of liquid according to claim 2, wherein:

said liquid is molten metal and is dispensed at low velocity and cast into strip form.

4. Apparatus for transforming a pulsating flow of liquid and dispensing a constant flow of liquid, comprising:

a. A rotatable container for holding and regulating flow of a liquid, having closed sides, a bottom, an opening for receiving a pulsating flow of liquid, and an opening for dispensing liquid, said container being rotatably supported by a bearing surface having a horizontal axis being generally vertically coplanar with said receiving and dispensing openings, said container adapted to hold variable amounts of said liquid and extending laterally beyond said horizontal axis so as to create a torque force about said horizontal axis when holding a given level of liquid and thereby to cause said container to rotate about said horizontal axis; and b. countertorque means comprising a counterweight connected to said rotatable container for applying a torque force to said container that balances the torque force created by said container and its contained liquid and causes the liquid depth above said dispensing opening to remain essentially constant despite rotation of said container about said horizontal axis and variations in the volume of the liquid whereby said liquid may be dispensed from said dispensing opening at a substantially constant flow.

5. Apparatus for transforming a pulsating flow of liquid and dispensing a substantially constant flow of liquid according to claim 1, wherein:

said countertorque means comprise a fixed weight attached to said rotatable container.

6. Apparatus for transforming a pulsating flow of liquid and dispensing a substantially constant flow of liquid according to claim 1, wherein:

said rotatable container comprises a first chamber containing said receiving and dispensing openings; said first chamber being open to a second chamber which extends laterally beyond the horizontal axis of the bearing surface and is adapted to hold a variable quantity of liquid.

7. A tundish for transforming a pulsating flow of molten metal and dispensing a constant flow of molten metal operatively associated with means for feeding molten metal into a receiving opening of said tundish and means for receiving and casting molten metal upon its exit from a dispensing opening of the tundish said tundish comprising:

d. rotatable tundish for holding and regulating flow of molten metal having closed sides, a bottom, an opening for receiving a pulsating flow of molten metal, and an opening for dispensing molten metal, said tundish being rotatably supported by a bearing surface having a horizontal axis being generally vertically coplanar with said receiving and dispensing openings, and tundish adapted to hold variable amounts of said molten metal and extending laterally beyond said horizontal axis so as to create a torque force about said horizontal axis when holding a given depth of molten metal and thereby to cause said tundish to rotate about said horizontal axis; and b. countertorque means comprising a counterweight connected to said rotatable tundish for applying a torque force to said tundish that balances the torque force created by said tundish and its contained molten metal and causes the molten metal depth above said dispensing opening to remain substantially constant despite the rotation of said tundish about said horizontal axis and variations in the volume of the molten metal whereby said molten metal may be dispensed from said dispensing opening at a substantially constant flow.

8. A tundish for transforming a pulsating flow of molten metal and dispensing a constant flow of molten metal operatively associated with means for feeding molten metal into a receiving opening of said tundish and means for receiving and casting molten metal upon its exit from a dispensing opening of the tundish according to claim 7, wherein:

said countertorque means comprise a fixed weight attached to said rotatable tundish.

9. A tundish for transforming a pulsating flow of molten metal and dispensing a constant flow of molten metal operatively associated with means for feeding molten metal into a receiving opening of said tundish and means for receiving and casting molten metal upon its exit from a dispensing opening of the tundish, according to claim 7, wherein:

said rotatable tundish comprises a first chamber containing said receiving and dispensing openings; said first chamber being open to a second chamber which extends laterally beyond the horizontal axis of the bearing surface and is adapted to hold a variable quantity of molten metal.

* * * * *

UNITED STATES PATENT OFFICE

CERTIFICATE OF CORRECTION

Patent No. 4,073,334 Dated February 14, 1978

Inventor(s) Charles Christian Gerding

It is certified that error appears in the above-identified patent and that said Letters Patent are hereby corrected as shown below:

Claim 5, line 16: "claim 1" should be deleted and replaced by -- claim 4--;

Claim 6, line 22: "claim 1" should be deleted and replaced by -- claim 4--;

Claim 7, line 33: insert -- , -- after "tundish".

Claim 7, line 35: "d" should be deleted and replaced by -- a--; and

Claim 7, line 42: "and" should be deleted and replaced by -- said--.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*